United States Patent [19]

Munson

[11] 4,408,671

[45] Oct. 11, 1983

[54] ROLLER CONE DRILL BIT

[76] Inventor: Beauford E. Munson, P.O. Box 3047, Butte, Mont. 59702

[21] Appl. No.: 350,280

[22] Filed: Feb. 19, 1982

Related U.S. Application Data

[63] Continuation of Ser. No. 143,340, Apr. 24, 1980, abandoned.

[51] Int. Cl.[3] ..... E21B 10/16

[52] U.S. Cl. ..... 175/377; 175/376

[58] Field of Search ..... 175/331, 376, 377, 378

[56] References Cited

U.S. PATENT DOCUMENTS

| | | | |
|---|---|---|---|
| 1,663,332 | 3/1928 | Bull | 175/377 X |
| 1,860,587 | 5/1932 | Metzger | 175/377 X |
| 2,046,739 | 7/1936 | Harrington | 175/377 X |
| 2,177,332 | 10/1939 | Reed | 175/377 X |
| 2,228,286 | 1/1941 | Ross | 175/377 X |
| 2,365,266 | 12/1944 | Hamaker | 175/377 X |
| 2,901,224 | 8/1959 | Bolce et al. | 175/377 X |
| 3,265,139 | 8/1966 | Haden et al. | 175/377 X |

*Primary Examiner*—Stephen J. Novosad
*Assistant Examiner*—Michael Starinsky
*Attorney, Agent, or Firm*—Robert E. Browne

[57] ABSTRACT

A roller bit for use with a drill string, having at least two cutters which are generally conically shaped; each cutter includes one or more teeth in inclined planes across a conical surface. The bit is attached to the drill string with the axis of rotation of the cutter angled with respect to the longitudinal axis of the drill string. The teeth on each cutter are arranged for maximum cuttings size and penetration rate.

7 Claims, 6 Drawing Figures

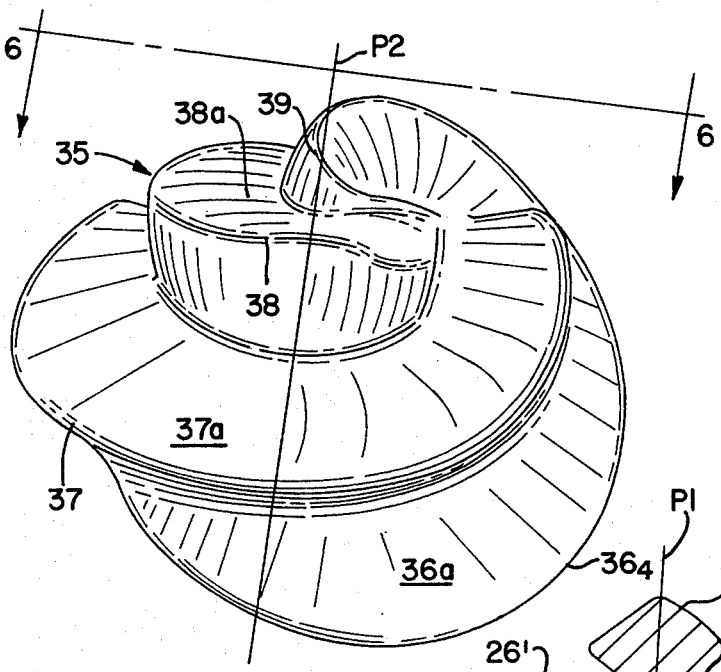
FIG. 4
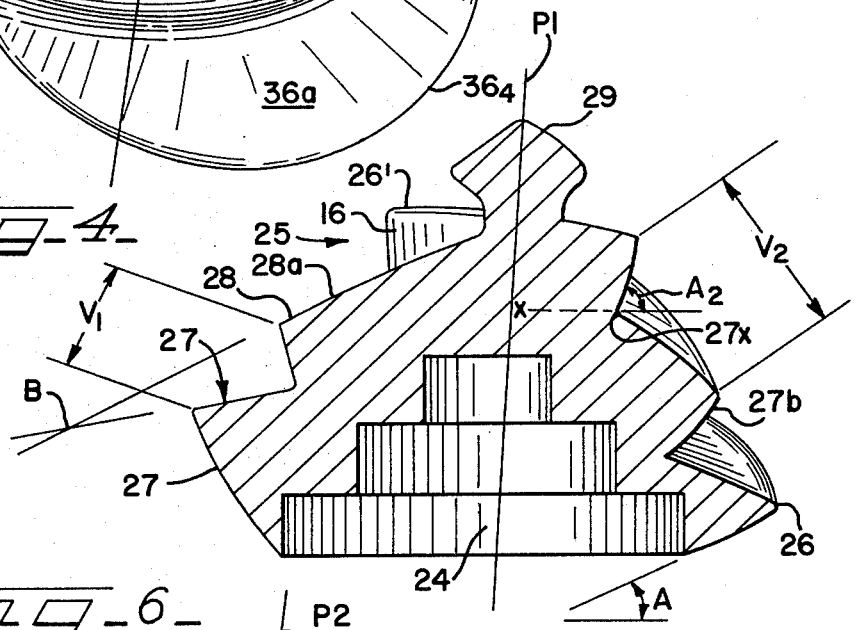
FIG. 5
FIG. 6
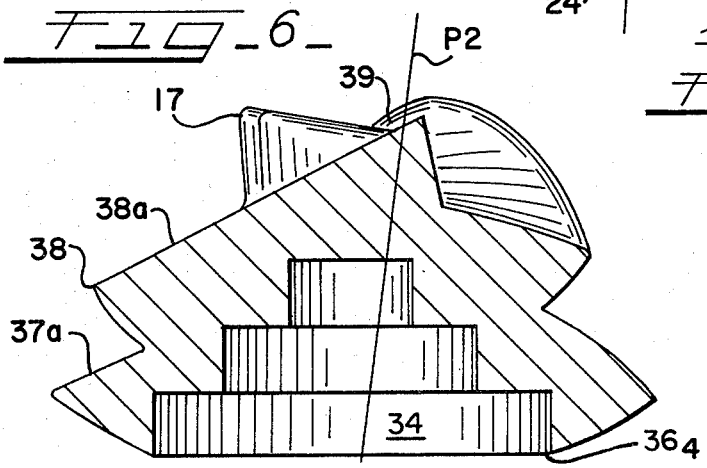

ROLLER CONE DRILL BIT

This is a continuation of application Ser. No. 143,340, filed Apr. 24, 1980 now abandoned.

DESCRIPTION

1. Technical Field

This invention relates in general to rotary drills for deep-well drilling and, in particular, to an improved drill bit having teeth providing improved shearing and crushing action.

2. Background of the Prior Art

In general, equipment for drilling wells and for mining dates back many centuries. Of late, such drilling equipment comprises a rotary drill string which is stabilized in the hole being drilled. The drill bit itself is on the end of this rotating shaft and, by its rotating action, cuts through the rock or other strata in which the hole is being made. Drilling fluid, usually air or mud, is circulated through the rotary drill string cooling the drill bit, simultaneously purging the core bottom. U.S. Pat. Nos. 3,302,983 and 3,659,663 show various means for stabilizing the rotary drill string within the bore, while U.S. Pat. Nos. 959,539; 1,143,272; 1,860,587 and 2,169,640 show various drill bit structures which may be utilized in boring a hole. When considering pentration rate, the method in which the formation is stressed is important. Traditionally, the rolling cutter rock bit penetrates a formation by applying a vertical pressure until it yields. The formation is stressed by a series of individual circumferentially-spaced teeth. However, it would also appear important to develop a stress sequence that not only stresses the formation vertically but laterally as well. Other factors which should be considered in increasing the efficiency, and thus the penetration rate of a drill bit, in addition to lateral pressure intensities, is the self-cleaning capability, or lack thereof, of the bit or cutter, and the capability of the bit to overcome formation strength. Other factors which are important to the structure of an effective drill bit will become apparent and are discussed below.

Therefore, an object of the subject invention is a rotary drill bit which can efficiently cut through rock with a high rate of penetration.

An additional object of the subject invention is a rotary drill bit in the shape of a cone having teeth of such a structure and relationship to one another that the penetration rate is greatly enhanced.

Yet another object of the subject invention is a drill bit which is self-cleaning during the drilling function.

Still another object of the subject invention is a roller drill bit having teeth shaped and spaced in a precise relationship for increased penetration rate and maximum cutting size.

SUMMARY OF THE INVENTION

These and other objects are attained in accordance with the present invention wherein there is provided a roller drill bit comprising two roller cone cutters which rotate on axes substantially perpendicular to one another. Each roller cutter or cone is generally frustoconical in overall shape, with a plurality of irregularly-spaced and inclined teeth. The teeth on each roller cutter are complementary, each having a lead tooth extending from the base to the apex of the roller cone cutter. In addition, the spacing between adjacent teeth increases as the cross-sectional area of the cone roller bit decreases. The respective cones are also tapered differently, aiding in the creation of dissimilar, but complementary, teeth patterns on each cone roller cutter. The teeth on each roller cone cutter are formed in planes which, viewed in cross-section along its axis of rotation, are intersecting, adding to the crushing and shearing action of the roller bit in operation.

BRIEF DESCRIPTION OF SEVERAL VIEWS OF DRAWINGS

The foregoing and other objects, features and advantages of this invention will become apparent from the following more particular description of embodiments of the invention as illustrated in the accompanying drawings wherein:

FIG. 4 is a perspective view of another rotary cone of the subject invention taken along line 4—4 showing its tooth pattern;

FIG. 5 is a cross-sectional view of the rotary cone of FIG. 3 along the line 5—5 showing the intersecting planes of the teeth of the rotary cone;

FIG. 6 is a cross-sectional view of the rotary cone of FIG. 4 showing the intersecting planes of the teeth of the rotary cone.

DETAILED DESCRIPTION

Figure 1:
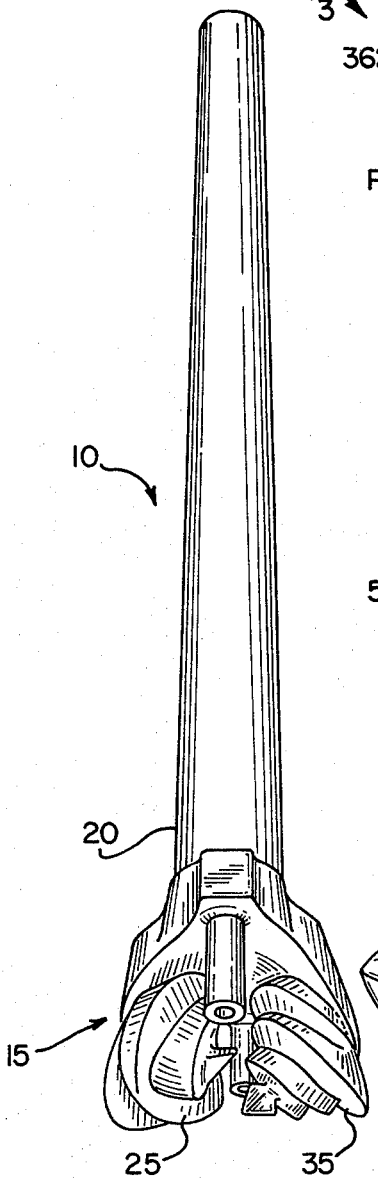
FIG. 1 is a perspective view of a rotary drill string utilizing the rotary drill bit of the subject invention.

Referring now to FIG. 1, there is shown a drill string 10 having a central shaft 20 which is stabilized for rotation by stabilizer rollers or the like as known in the art. Secured to the end of the shaft 20 is roller bit assembly 15. Rotatably mounted on the roller cone bit assembly 15 are individual cone cutters 25 and 35.

Figure 2:
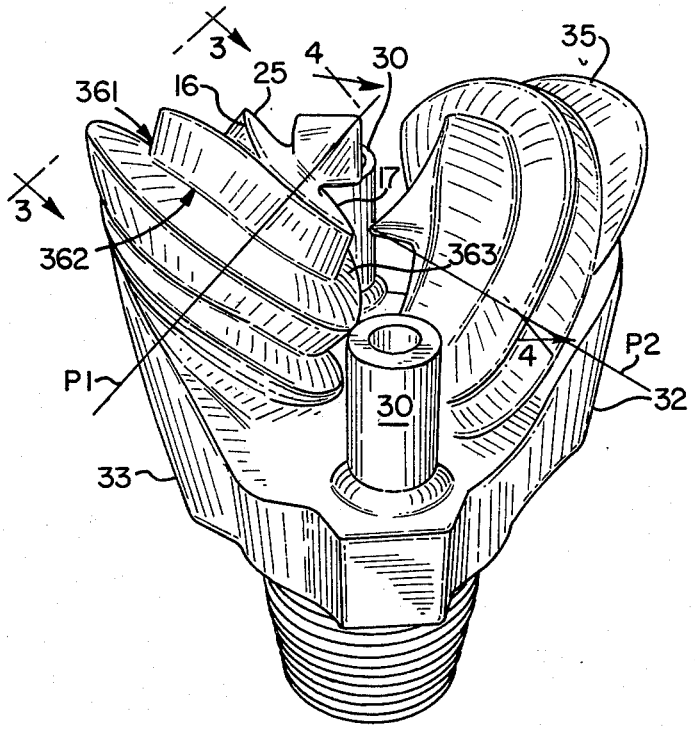
FIG. 2 is a perspective view of a rotary drill bit of the subject invention.

As can be better seen in FIG. 2, cutters 25 and 35 are each rotatably mounted on ears 32 and 33, respectively, through bearings mounted on seats 24 and 34 within the cone cutters. The axes of rotation of the roller cones lay approximately at a 90° angle to one another and at approximately 45° angles to normal. In the mid-portion of the roller bit assembly 15 and to either side of the roller cones are cooling fluid injection ports 30 for injecting a cooling fluid such as mud or the like for cleaning the teeth of the rotary cone bits, facilitating circulation and carrying the cuttings up and away from the bottom of the hole.

Each roller cone cutter has a configuration different from the other, although all have teeth of large size having both a large pitch and a large depth.

Figure 3:
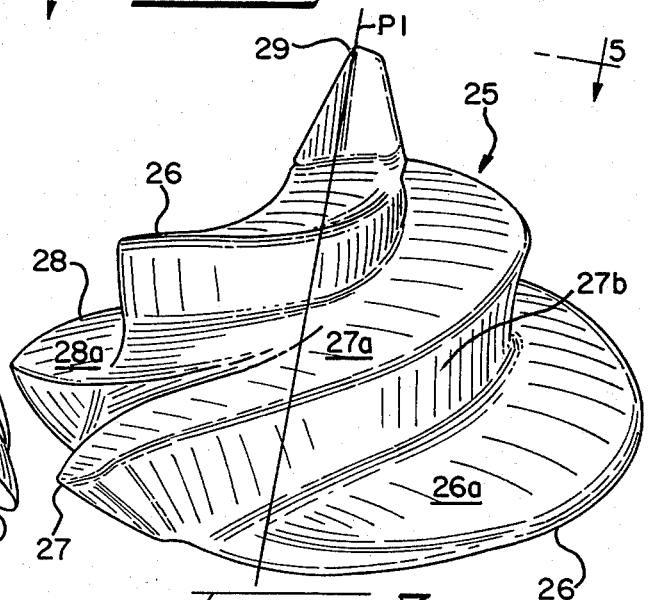
FIG. 3 is a perspective view taken along line 303 of FIG. 2 showing the teeth pattern of one rotary cone of the subject invention.

In particular, roller cone cutter 25, shown in FIGS. 3 and 5 has major teeth 26, 27 and 28. The planes 26*a*, 27*a* and 28*a* of each tooth are generally at inclined angles to a plane P1 that extends from the apex 29 of the roller cone cutter 25 to the center of the base of the cone. The general curvature of each tooth obscures much of the pattern of such inclined planes which, while generally in an upward direction towards the apex of the cone, constantly varies its degree of inclination, thereby yielding greater penetration rates, as will be discussed. In other words, each of the general tooth planes intersects with the others while the tooth contour varies within the plane. A tooth pattern is created in this manner which forms a cutting structure for formation loading which may be constant in vertical pressure intensities yet varied in lateral pressure intensities.

Roller cone cutter 35, shown in FIGS. 4 and 6, has teeth which are also at inclined angles to the plane P2 that extends from the apex of the roller cone cutter, generally shown at 39, to the center of the base of the cone. Each of these planes are intersecting and, in addition, the angle of the inclined planes are in continuous change as the plane transverses the face of the cone as a result of the irregular frustoconical shape of the cone and the shape of the tooth itself.

Roller cone cutter 35 also has three teeth 36, 37 and 38, one of which 37 is the lead tooth. Lead tooth 37 is the longest tooth on the cone 35 and also has a greater number of inclined plane combinations or changes. These plane angle changes of lead tooth 37 are complimentary, not identical, to the plane angle changes of the lead tooth 27 of roller cone cutter 25. This relationship is true for each tooth on opposing roller cone cutters. As a direct result of such complementary plane angles, in cutting through a rock formation, no tooth of either roller cone cutter ever hits a rock formation at the same angle as a following tooth. Thus, consecutive elongated craters inflicted on the rock formation will always be intersecting, creating an environment in which the formation can yield to the lateral forces that are simultaneously exerted upon it, therefore, increasing the rate of rock failure.

Contributing to the disparate planes in the roller cone cutters 25 and 35 is the fact that the cones themselves of the roller cone cutters have unequal tapers; further, as the area of the cone decreases, the spacing between the teeth increases. Further, as the area of the cone decreases, that is, as the teeth move toward the apex 29 of the cone, the spacing between the teeth increases. This increase is shown, for example, in FIG. 4 where V1 represents the distance or spacing between tooth 27 and tooth 28 at a first point relative to apex 29 and where V2 represents the distance between the same tooth 27 and the same tooth 28 at a second point closer to apex 29. Thus, the problem associated with rock cuttings migrating toward the center or apex of the cutter and compacting and plugging the teeth at the point is alleviated. The teeth actually diverge as they cross the face of the cone and, therefore, the cuttings will not migrate toward the center of the roller cone cutter and there will be no compacting of the rock material at that point or the area about the center.

In addition to the increased spacing of the teeth as they near the apex, the teeth wedge angle A (inside face angle which is the angle formed between the tooth plane or tooth face, such as 27*a*, and a line x drawn perpendicular to plane P1 through the base point 27*x* of tooth plane 27*a*, as shown in FIG. 5) also increases to compensate for the rapid increase in the inclined plane of the tooth as it nears the bit apex. The greater tooth wedge angle reduces the shearing action and increases crushing action of the tooth, all for maximum cuttings size and increase penetration rate. Thus, the wedge angle A of a tooth will change, as at 27, where the tooth appears to climb to the apex of the cone. In a preferred embodiment, a tooth may end abruptly as at 16 and 17, further contributing to the discontinuous nature of the rotary cone bit of the subject invention.

Another benefit of the increase in the tooth spacing toward the center of the cutter is a larger cuttings size, that is, the roller cone cutter can take a larger bite out of the formation material being penetrated. With such a larger bite, the penetration rate can be greatly increased.

As stated above, not only does the inclined plane as illustrated by planes 27*a* and 28 a intersecting at B of each tooth intersect and the spacing between the teeth increase, but also the plane of each tooth on a roller cone bit continually changes. As a result of such intersections of the planes and variations in the tooth spacings, the lateral pressure intensities exerted by the teeth fluctuate, thereby increasing the cuttings obtained through the rotation of the roller cone cutter. Stated another way, the teeth do not contact the formation material in the same place at the same intensity or load. Thus, a tooth may bear down on a formation material along a certain plane, simultaneously moving laterally for a greater stressing and yielding of the formation material. As the roller cone cutter rotates, it will contact the same formation material on an intersecting plane and also in a manner in which the tooth contacting the formation material will move laterally to increase the formation stressing and yielding. As the roller drill bit assembly rotates bringing the respective roller cone cutters into contact with different formation material with each rotation of the drill bit, the formation material is cratered in each pass of the roller cone cutter from a different angle, thereby increasing the penetration rate and breaking up the formation material with the maximum cuttings size.

While the invention has been described with reference to a preferred embodiment, it will be understood by those skilled in the art the various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out the invention, but that the invention will include all embodiments falling within the scope of the appended claims.

I claim:

1. A roller bit for use with drilling strings in the penetration of earth, as in drilling through rock formations, said roller bit comprising first and second roller cone cutters, each of said roller cone cutters formed in a generally conical configuration and having a base and an apex, said first roller cone cutter revolving around a first axis, said second roller cone cutter revolving around a second axis, said first and said second roller cone cutters each having a plurality of teeth extending in planes about the perimeter of each of said roller cone cutters, said teeth extending generally from the base toward the apex of each of said roller cone cutters, the spacing between adjacent teeth on the same roller cone cutter increasing as said adjacent teeth extend from said base of said roller cone cutter toward said apex thereof, thereby allowing larger cuttings and increased cleaning action of said cutter.

2. The roller bit of claim 1 wherein the planes of inclination of each tooth of each roller cone cutter is continuously varied.

3. The roller bit of claim 1 wherein the inside face angle of said teeth increases as the cross-sectional area of the roller cone associated with said teeth decreases.

4. A drill string assembly for drilling of deep holes in rock and other materials, said assembly including a drill string, a bit assembly mounted on a lower end of said drill string, a first and second roller cone cutter on said bit assembly, said first roller cone cutter revolving about a first axis, said second roller cone cutter revolving about a second axis, said first and said second roller cone cutter each having a plurality of teeth extending in planes about the face of said roller cone cutter, each of the planes of said teeth of said roller cone cutters varying in the inclination of said planes, thereby providing for increased lateral stress on the rock formation.

5. The drill string assembly of claim 4 wherein said teeth of said first roller cone cutter and said second roller cone cutter are different in size, pitch and spacing and extend in different planes across the face of said roller cone cutters.

6. The drill string assembly of claim 4 wherein each of said roller cone cutters has a plurality of teeth extending around the perimeter of said roller cone cutter and adjacent teeth of each roller cone cutter have an increasing spacing between them as they move from the base toward the apex of an associated roller cone cutter.

7. The drill string assembly of claim 1 wherein each of said teeth extending in planes about the face of said roller cone cutters intersect one another for subjecting the rock formation to varied patterns of stress when drilling.

* * * * *